US006253695B1

(12) United States Patent
Chan et al.

(10) Patent No.: US 6,253,695 B1
(45) Date of Patent: Jul. 3, 2001

(54) METHOD OF CHANGING THE DENSITY OF AN EMBROIDERY STITCH GROUP

(76) Inventors: Tik Yuen Chan, 400 N. Church, Suite 609; King Wa Leung, 400 N. Church, Suite 203, both of Charlotte, NC (US) 28202; Wei Wang, 9221 Glenwater Dr., Apt. 707, Charlotte, NC (US) 28262

( * ) Notice: Subject to any disclaimer, the term of this patent is extended or adjusted under 35 U.S.C. 154(b) by 0 days.

(21) Appl. No.: 09/391,392

(22) Filed: Sep. 8, 1999

Related U.S. Application Data

(60) Provisional application No. 60/099,341, filed on Sep. 8, 1998.

(51) Int. Cl.[7] ..... D05C 5/02
(52) U.S. Cl. ..... 112/475.19
(58) Field of Search ..... 112/475.19, 102.5, 112/456, 458; 700/138

(56) References Cited

U.S. PATENT DOCUMENTS 5,576,968 * 11/1996 Mizuno et al. ..... 112/475.19 X
5,839,380 * 11/1998 Muto ..... 112/102.5

* cited by examiner

*Primary Examiner*—Peter Nerbun
(74) *Attorney, Agent, or Firm*—Banner & Witcoff, Ltd.

(57) ABSTRACT

A method of changing the density of an embroidery stitch group for use with an electronically controlled embroidery machine. The type of stitch is first recognized, then its points and locations and the penetration point of the inside line and the outline of the stitch is determined. Stitches in the closest relative lines are then copied, moved or removed to increase or decrease the density of the stitch group.

7 Claims, 7 Drawing Sheets

METHOD OF CHANGING THE DENSITY OF AN EMBROIDERY STITCH GROUP

CROSS-REFERENCE TO RELATED APPLICATION

The present application claims the priority of provisional application Ser. No. 60/099,341 filed Sep. 8, 1998.

BACKGROUND OF THE INVENTION

The present invention generally relates to the field of electronically controlled embroidery machines and more particularly is directed to a method of changing the density of an embroidery stitch group.

Embroidery machines are well known in the prior art. Most modern day machines are electronically controlled and can embroidery a complex pattern onto a variety of materiels using different color threads and stitches.

FIG. 1 illustrates the construction of a typical electronically controlled embroidery machine as known in the prior art, for example, as described in U.S. Pat. No. 4,849,902. The machine includes a needle bar 3 which holds a plurality of embroidery needles 7. Each needle can carry a different kind of thread which can vary in color, texture, etc. as may be required by the particular pattern to be embroidered. Each needle also is independently driven and controlled by a computer unit which controls the operation of the machine.

As shown in FIG. 1, the embroidery machine also includes a movable workpiece pantograph 10 on which the material or workpiece W to be embroidered is placed. The workpiece W is held in place by hoop 14. Pantograph 10 can be moved in an x-axis and a y-axis as indicated by arrows X and Y, respectively, so that any point on workpiece W can be located below the appropriate needle for a particular series of stitches. The x-y coordinate movement of the workpiece is controlled by the computer control unit as required by the particular pattern to be embroidered.

FIG. 2 is a block diagram illustrating the basic construction of a control unit which may be used to control the operation of a electronically controlled embroidery machine. As shown in FIG. 2, the control unit includes a number of interrelated elements all operationally connected by a bus 200. The system includes RAM memory 201 and ROM memory 202 where instructions and temporary data storage areas of a computer program reside. The system also includes a display 205 and a keyboard 204 so that the various functions of the system and be initiated and observed. Display 205 can be formed of a number of different devices including a liquid crystal display, a cathode ray tube display and an LED display. In addition, a number of different configurations for keyboard 204 can be used.

The control unit may also include disk storage device 206 which allows the system to store data to and receive programming instructions from such devices as magnetic floppy disks and tape units.

Also connected to buss 200 are output port 208 and input port 207. Output port 208 provides control signals which control the movement of the workpiece pantograph along the x and y axis as well as other embroidery machine operations such as stopping, starting and pausing the machine, needle selection and needle movement. These control operations are performed in accordance with stitch data typically stored in memory within the machine control unit which presents a particular pattern or image to be embroidered. This data is then acted upon by the control unit in order to provide the particular control functions necessary for the machine to embroider the desired pattern.

Input port 207 receives input signals for the control unit to respond to various status information concerning the state or condition of the embroidery machine. For example, should a thread break the breakage must be detected by the control unit so that the machine can be stopped and appropriated alarms activated so that the machine operator can be alerted to correct the problem. Other machine parameters such as excessive or insufficient thread tension may also be detected and appropriate action taken by the control unit. The control unit also receives positive feedback of the precise location of the workpiece pantograph. In many machines, moving the pantograph to a new location involves indexing the pantograph a number of unit increments in the x and/or y direction from its present location.

The heart of the control unit is central processing unit (CPU) 203 which supervises the flow of information between the various elements of the system and which perform logic calculations and other functions based on instructions in the computer program stored in RAM 201 and ROM 202. The control unit illustrated in FIG. 2 provides all of the capability of a computer system and can be easily programmed as such.

Over the years, a number of embroidery stitch patterns and groups have evolved. These include any one of or any variation of 3 major stitch types that have emerged in the prior art.

FIG. 3 illustrates these major stitch types. So call "fill" stitches are indicated by reference number 31 in FIG. 3. Fill stitches are used for the purpose of covering large, wide areas (>3 mm in width) of varying shapes with a textured field of stitches of one or more colors. The coverage is attained through progressive rows of stitching punctuated at even intervals by needle penetration points. The intervals are typically fewer than 12 mm apart and most commonly 4–5 mm apart on the same stitch row as known in the prior art. Because of the stability of the frequent needlepoint that anchors the thread, fill stitches are capable of covering areas wider than the limit dictated by prior art satin stitches (approximately 12.7 mm) as discussed below.

So-called "satin" or "radial" stitches are indicated by reference number 32 in FIG. 3. These stitches are used for the purpose of rendering narrower shapes (<12 millimeters in width). Examples include lettering, decorative detail such as plant stems/vines or as illustrated in FIG. 3, a border on the edge of a fill stitch. Satin stitches leave a smoother finish than fill stitches because there are no needle penetrations into the fabric along the embroidery thread except those on each side. Because of the lack of needle penetrations, satin stitches are rarely generated wider than 12 mm due to instability of the unanchored thread that increases with the width of the satin stitch.

So called "running" stitches are indicated by reference number 33 in FIG. 3. Such stitches are used to render detail with little or no dimensional thickness (<5 millimeters in height). Generally these consist of a sequence of stitching arranged to render a shape by following the outline of that shape rather than attempting to cover an area by adjacent rows of stitching, as is done with satin or fill stitches.

While many other stitch types exist, all are some variation of these 3 basic types. Such variations exist to render different effects to change the appearance of the sewn embroidery. Examples include but are not limited to jagged-edged satin and fill stitches; different patterns of running stitches for varying outline effects, cross-type stitching, and fill stitches whose interior needlepoint pattern has been manipulated to produce a desired effect.

FIG. 4 illustrates how the stitches would appear in a finished embroidery pattern. The satin stitch border renders a smooth, narrow patch. The fill stitch renders a textured background of a solid color. And the line stitches render the detail in the face.

The line, fill and satin stitch groups are used in combination in embroidery stitch files to embroider various designs. Nearly all embroidery stitch groups are generated based on a set of parameters, which may be manipulated to affect the final appearance of the sewn embroidery. The parameters are manipulated for reasons of desired artistic effect and to maintain the quality of the sewn embroidery if the same stitch file is sewn under varying conditions, including but not limited to different types of fabric, thread, or brand of embroidery machine. In some embroidery applications, it is advantageous for the aforementioned reasons to change the stitch parameters of one or more stitch groups, such as the density of the stitches.

A number of techniques are known in the prior art for changing stitch density, but none have proven effective for all stitch groups. Typical shortcomings of such techniques are discrepancies with the consistency of the density throughout a stitch group, and a change in the needlepoint pattern that had been originally created by the creator of that particular stitch file. Accordingly, there is a great need in the art for a more effective method of changing stitch density which eliminates or greatly reduces the disadvantages of current methods.

SUMMARY OF THE INVENTION

Accordingly, it is an object of the present invention to obviate the above-noted shortcomings and disadvantages of methods of changing stitch density know in the prior art.

Accordingly, it is an object of the present invention to provide a method of changing stitch density which can be automatically used without user intervention.

It is a still further object of the present invention to provide a method of changing stitch density which is economical to use and is simple in operation.

It is a still further object of the present invention to provide a method of changing stitch density which is low in cost to implement and can be readily used with existing embroidery machines.

It is another object of the present invention to provide a method of changing stitch density which can be readily used with electronically controlled embroidery machines.

These and other objects of the present invention will become apparent to those of ordinary skill in the art.

BRIEF DESCRIPTION OF THE DRAWINGS

The novel features of the present invention are set out with particularity in the appended claims, but the invention will be understood more fully and clearly from the following detailed description of the invention as set forth in the accompanying drawings in which:

DESCRIPTION OF THE PREFERRED EMBODIMENT

A preferred embodiment of the present invention will now be described with reference to the accompanying drawing.

Figure 1:
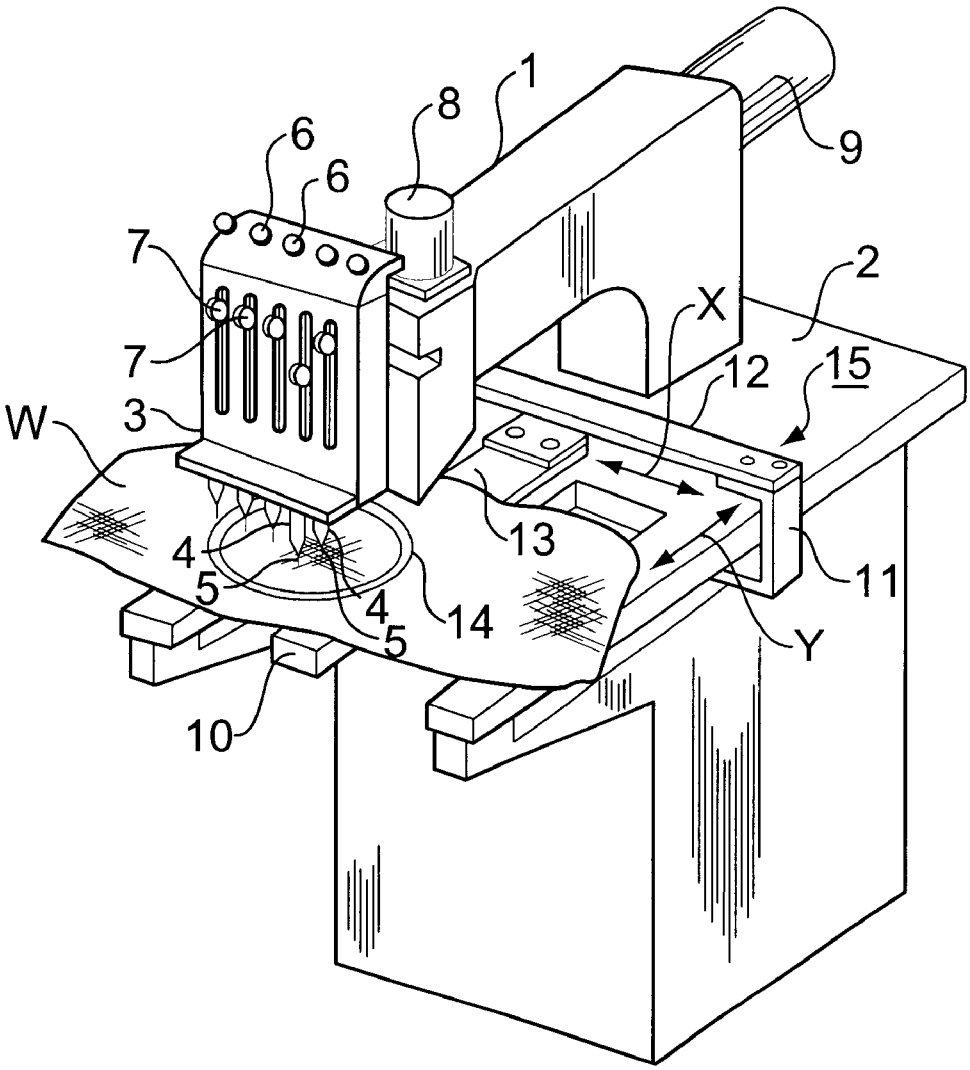
FIG. 1 illustrated the construction of an embroidery machine as know in the prior art.
Figure 2:
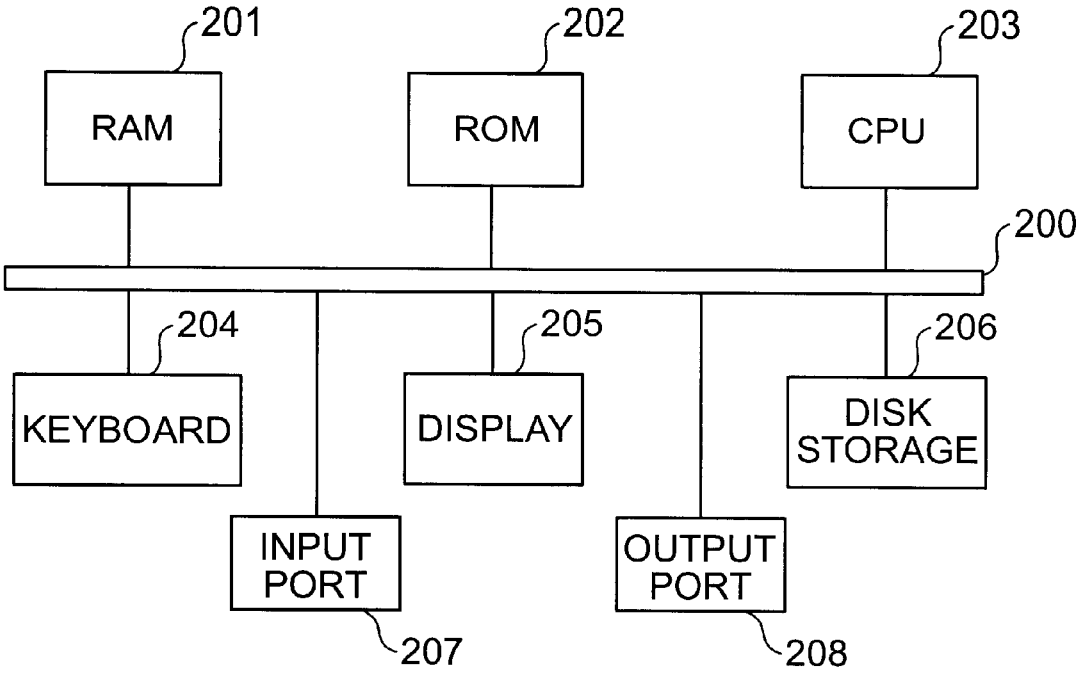
FIG. 2 is a block diagram of the computer control unit for an embroidery machine.
Figure 3:
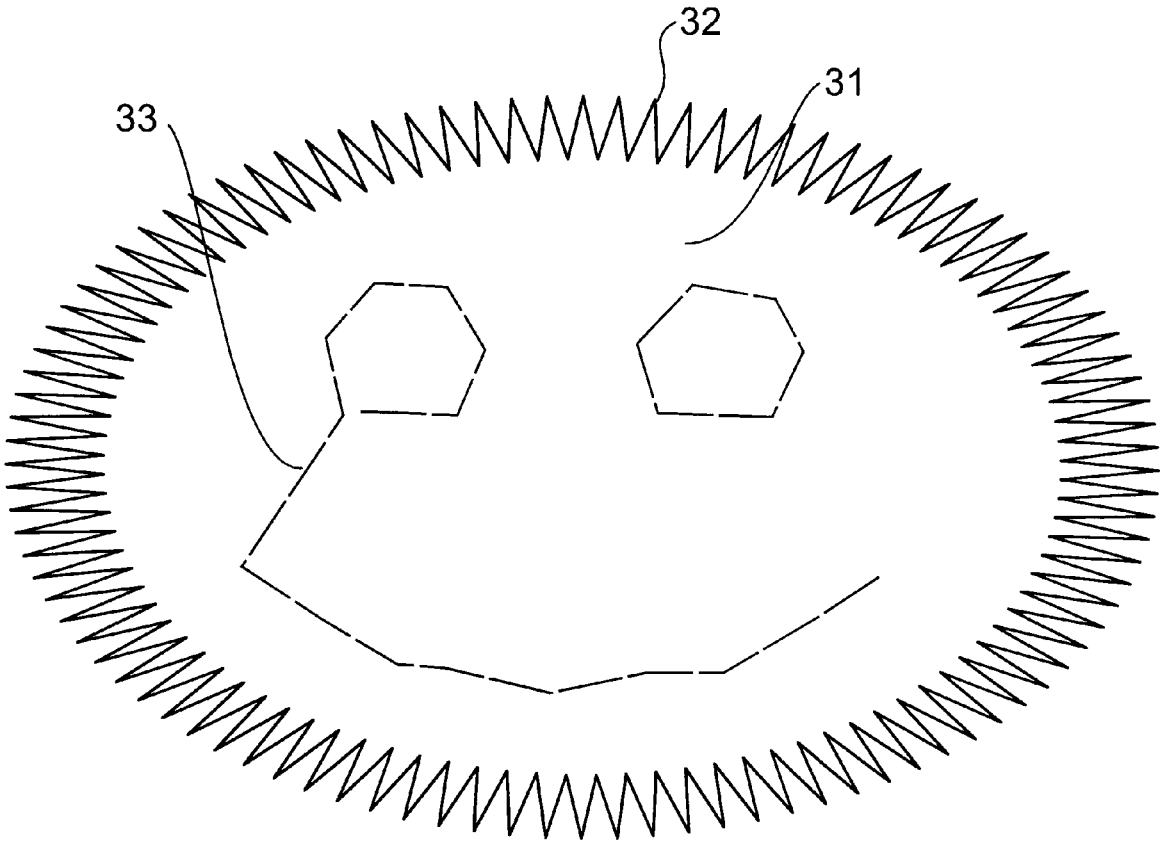
FIG. 3 illustrates running, fill and satin stitch types as known in the prior.
Figure 4:
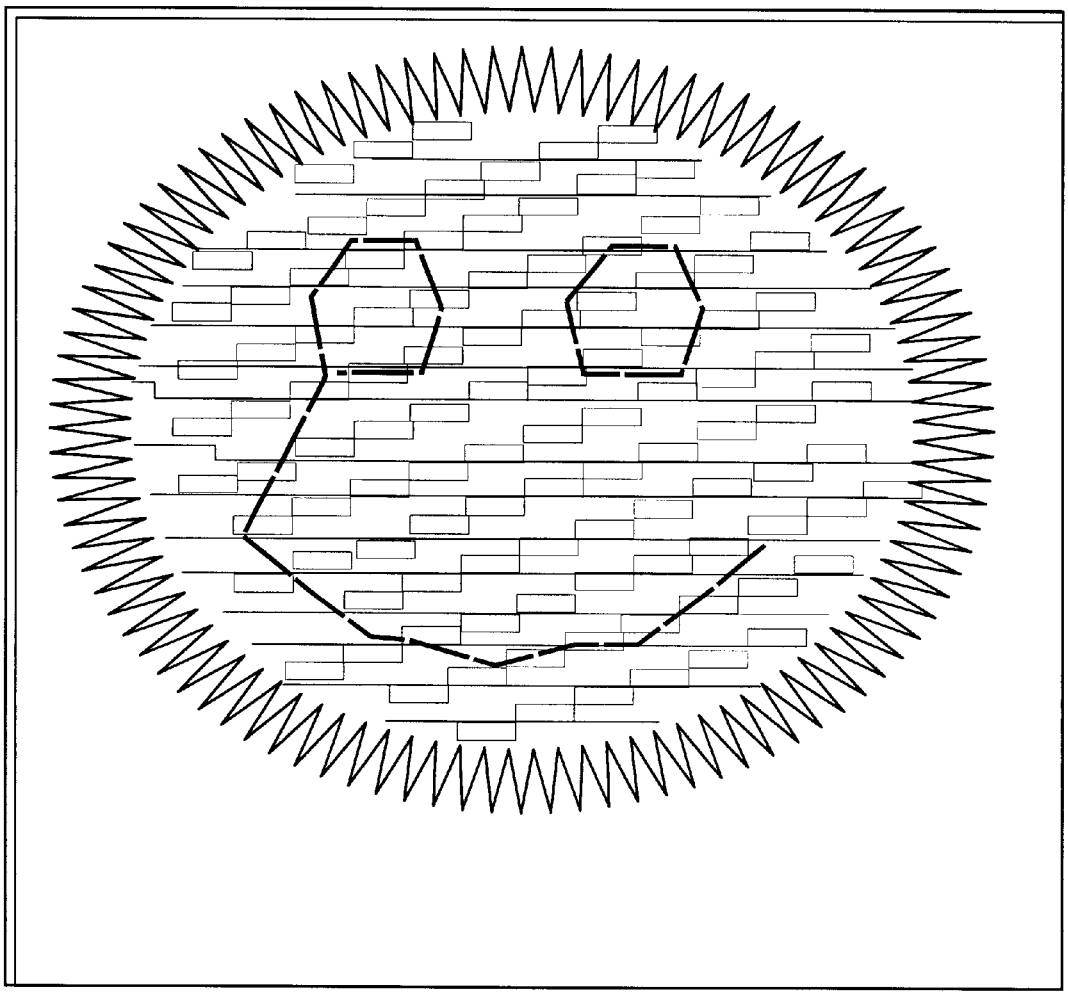
FIG. 4 illustrates how the running, fill and satin stitches appear in a finished embroidery pattern.
Figure 5:
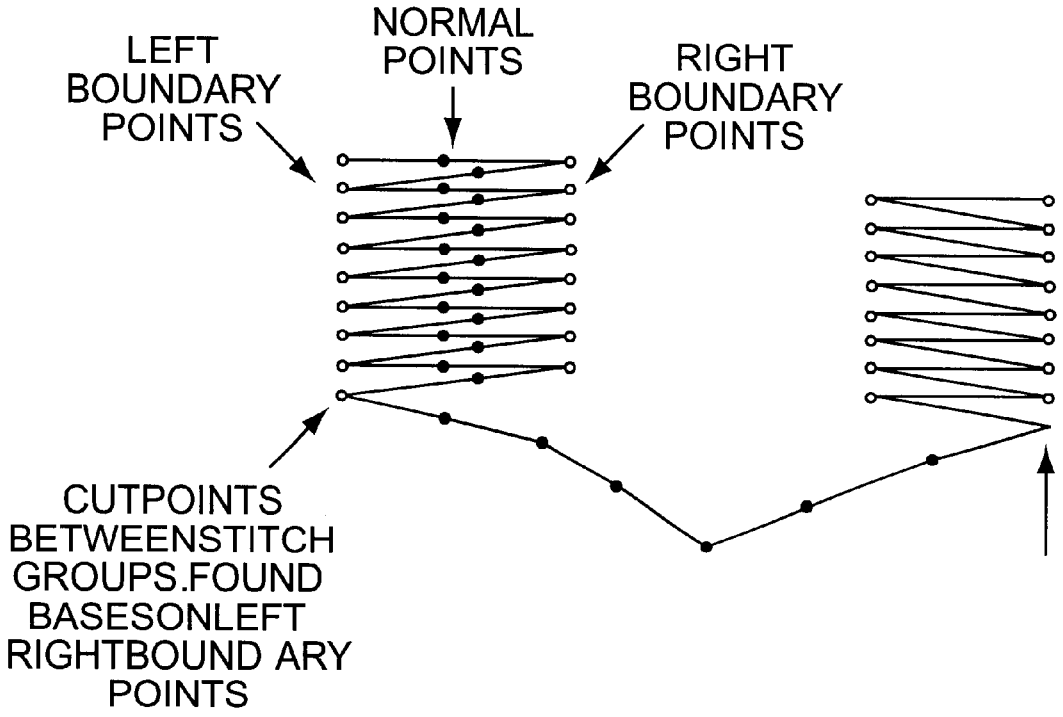
FIG. 5 is an illustration of stitch groups points with respect to the method of changing stitch density in accordance with the present invention.

The method of changing stitch density in accordance with the present invention involves recognizing the type of stitch, its points and locations and the penetration point of the inside line and the outline as illustrated in FIG. 5. The boundary points are then classified into left boundary and right boundary points. Based on the series of left-right boundary points, the stitches are separated in to a plurality of groups as normal stitch groups and running stitch groups. A measurement is also made of the overall density, based on the dimensions of that stitch group as determined by the left-right boundary points and the number of rows of stitches comprising that stitch group.

For normal stitch groups, which include but are not limited to the satin and fill stitch groups and their variations and hybrids as described above, the type of stitch is recognized based on the stitch pattern. Stitches in the closest relative lines are then copied, moved or removed to increase or decrease the density of the stitch group.

For running stitch groups, the groups are rearranged to increase or decrease the number of points. The points that change sewing angles are protected from adjustment to preserve stitch group shape.

Figure 6:
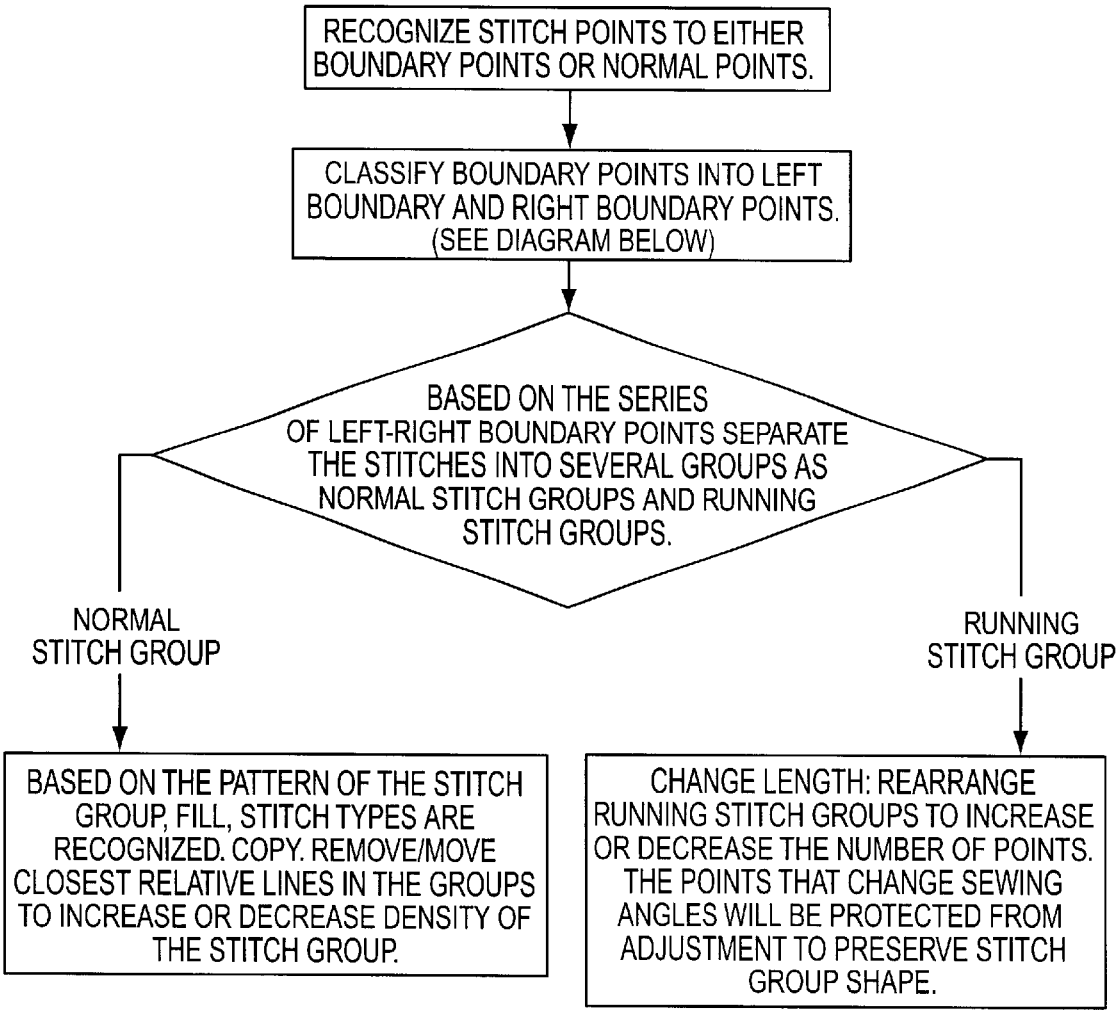
FIG. 6 is a block diagram illustrating the method of changing stitch density in accordance with the present invention.
Figure 7:
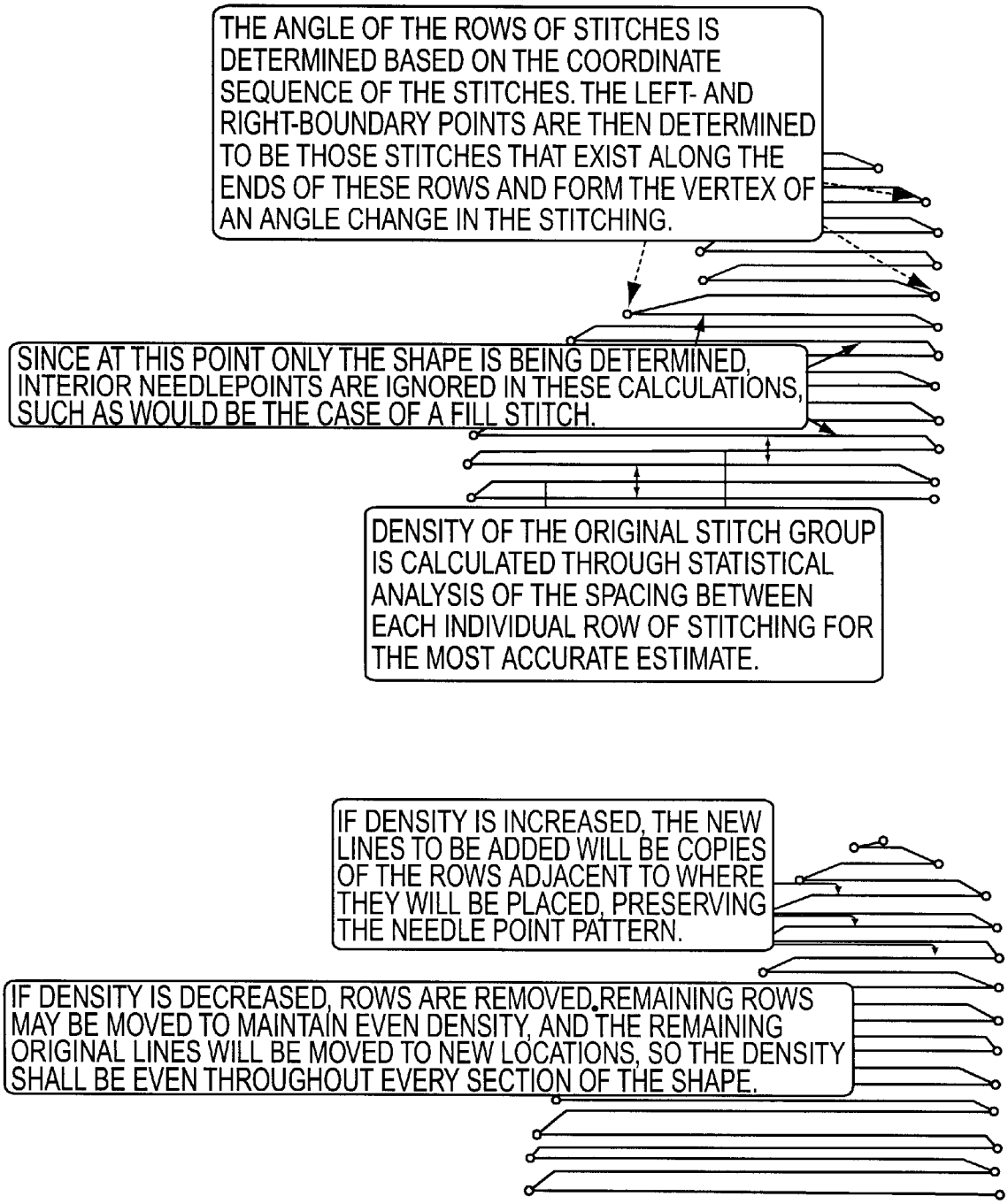
FIG. 7 is a further illustration of the method of changing stitch density in accordance with the present invention.

FIG. 6 is a flow chart illustrating the above described method of changing stitch density. It has been found that using this method allows the density of virtually any stitch group to be changed easily and automatically as may be required by the particular embroidery application. FIG. 7 further illustrates the method of changing stitch density in accordance with the present invention.

It is important to note that when the stitch density of the stitch group is changed, the original needle point pattern is not changed. This feature is not possible with prior art methods of changing stitch density and represents a break through in the embroidery industry. It is also important to note that when the stitch density of the stitch group is changed, the consistency of the density across that entire stitch group is improved. The density is evenly applied to every section of that stitch group, thus eliminating variations in the density of the original stitch group that may have existed.

It should be obvious from the above-discussed apparatus embodiment that numerous other variations and modifications of the apparatus of this invention are possible, and such will readily occur to those skilled in the art. Accordingly, the scope of this invention is not to be limited to the embodiment disclosed, but is to include any such embodiments as may be encompassed within the scope of the claims appended hereto.

We claim:

1. A method of changing the density of a plurality of embroidery stitches, said method including the step of:

recognizing a stitch left boundary point;

recognizing a stitch right boundary point;

recognizing a stitch normal boundary point;

classifying said boundary points into left and right boundary points;

separating said stitches into a plurality of stitch groups in accordance with their left and right boundary points; and calculating a density reading upon determining the left and right boundary points of said embroidery stitches.

2. The method of claim 1, wherein said classifying step including the step of further including the step classifying said boundary points into a normal stitch group or a running stitch group.

3. The method of claim 2, further including the step of copying the closest relative lines in said normal stitch group to increase the density of said stitch group in accordance with the pattern of the stitch group.

4. The method of claim 2, further including the step of removing the closest relative lines in said normal stitch group to decrease the density of said stitch group in accordance with the pattern of the stitch group.

5. The method of claim 2, further including the step of moving the closest relative lines in said normal stitch group to increase or decrease the density of said stitch group in accordance with the pattern of the stitch group.

6. The method of claim 2, further including the step of rearranging said running stitch groups to increase or decrease the number of said points.

7. The method of claim 6, wherein said rearranging step including the step of determining a change in sewing angle and to preserve stitch group shape.

* * * * *